United States Patent [19]

Bardebes

[11] 3,952,355

[45] Apr. 27, 1976

[54] INFLATABLE BUOYANCY AIDS

[76] Inventor: David Paul Bardebes, 12 Yatton St., Tauranga, New Zealand

[22] Filed: Oct. 30, 1974

[21] Appl. No.: 519,392

Related U.S. Application Data

[63] Continuation-in-part of Ser. No. 468,355, May 9, 1974, abandoned.

[30] Foreign Application Priority Data

Sept. 24, 1973 New Zealand ..... 172049

[52] U.S. Cl. ..... 9/316; 9/340

[51] Int. Cl.[2] ..... B63C 9/18

[58] Field of Search ..... 9/316, 317, 318, 319, 9/320, 340, 336, 338

[56] References Cited

FOREIGN PATENTS OR APPLICATIONS 508,611 7/1939 United Kingdom

*Primary Examiner*—Trygve M. Blix
*Assistant Examiner*—Gregory W. O'Connor
*Attorney, Agent, or Firm*—Ladas, Parry, Von Gehr, Goldsmith & Deschamps

[57] ABSTRACT

An inflatable bouyancy aid comprises an elongate, straight inflatable member, and a securing device attached to and extending from the inflatable member and adapted to encircle the trunk part of the body of a wearer. An actuating device is associated with a gas producing device located in or adjacent the inflatable member such that on operation of the actuating device an amount of gas flows into the inflatable member so as to inflate it and provide buoyancy for the wearer. The securing device extends from two positions spaced apart and removed from each end of the inflatable member to leave two end portions of the inflatable member, when inflated, extending in substantial tangential fashion from the body of the wearer.

9 Claims, 6 Drawing Figures

FIG. 1
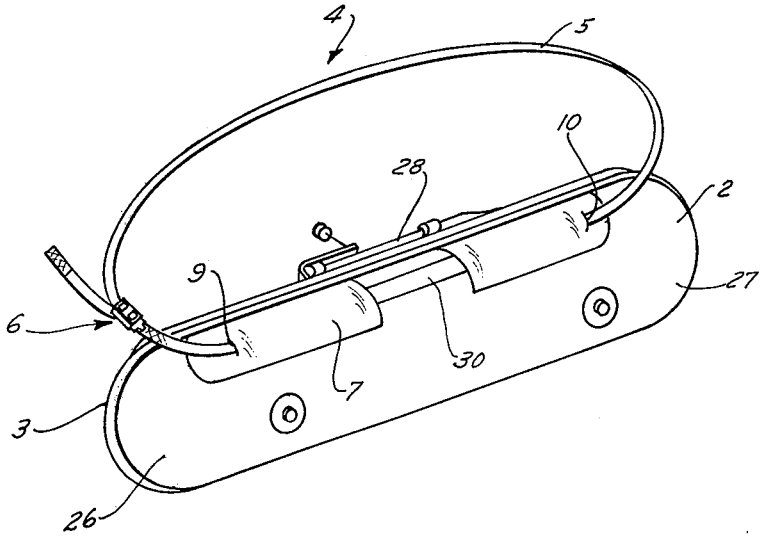
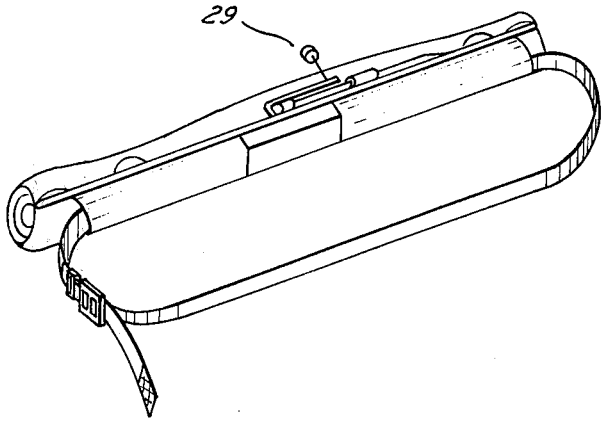
FIG. 2

INFLATABLE BUOYANCY AIDS

This is a continuation-in-part of application Ser. No. 468,355, filed 5/9/74, now abandoned.

This invention relates to inflatable buoyant devices and more particularly to a belt or the like, which may be worn by a person and inflated if and when buoyancy in the water is required.

It is an object of this invention to provide an inflatable buoyant device which can be readily worn by a person who may require support in the water and which can be easily inflated so as to provide the buoyant support needed in for example an emergency.

According to one aspect of this invention an inflatable buoyant device comprising an elongate inflatable member having straight longitudinal axis, securing means attached to and extending from said inflatable member and adapted to encircle the trunk part of the body of a person so that said securing means lies substantially in a plane substantially parallel to the longitudinal axis of the elongate member, an actuating device associated with a gas producing means located in or adjacent the inflatable member such that on operation of the actuating device an amount of gas flows into the inflatable member so as to inflate it and provide buoyancy for a person about which the securing means has been secured, characterised in that the securing means extends from two positions spaced apart and removed from each end of the inflatable member to leave two end portions of the inflatable member, when inflated and when secured to the body of the person by the securing means, extending in substantial tangential fashion from the body of the person.

Further aspects of this invention, which should be considered in all its novel aspects, will be apparent from the following descriptions given by way of example, of preferred embodiments of the invention.

Preferred forms of the invention will now be described with reference to the accompanying drawings in which:

FIG. 1 is a rearward perspective view from below of an inflated buoyant device in accordance with the present invention with the securing means displaced for clarity;

FIG. 2 is a perspective view from below of the inflatable buoyant device shown in FIG. 1 prior to inflation;

Figure 3:
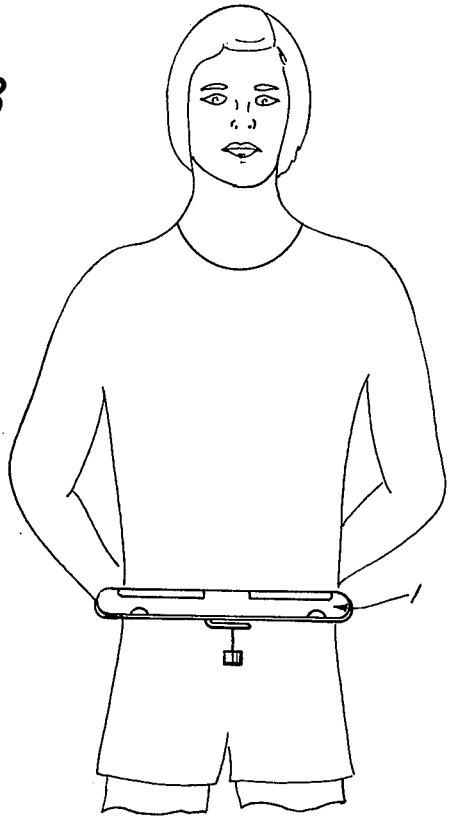
FIG. 3 shows the uninflated device n position on a person.

The buoyant device of the invention as shown in FIG. 1 has an elongate inflatable member 1 having a straight longitudinal axis. As shown in the drawings the inflatable member is of substantially tubular form having the two end surfaces 2 and 3 closed preferably having substantially ellipsoidal end surfaces. The elongate member 1 is made of a suitable rugged and waterproof material, for example, rubber or a rubberized synthetic material.

Figure 6:
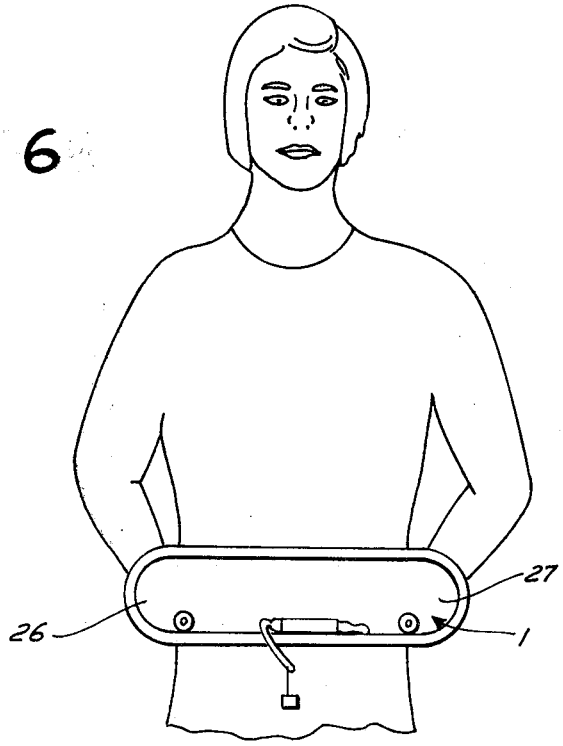
FIG. 6 shows the inflated device in position on a person.

Associated with the elongate inflatable member 1 is a securing means indicated by arrow 4 attached to and extending from the inflatable member 1, said securing means being adapted to pass about the trunk portion of the body of a person to secure said device to said person in the manner shown in FIGS. 3 and 6 such that the securing means lies within a plane substantially parallel to the longitudinal axis of the elongate member 1. The securing means can be for example in the form of a belt 5 joined by interlocking means 6 attached. The belt needs to be of a sufficient strength to support up to the wet weight of a person who can be for example equipped with full military drill equipment i.e. up to 350 lbs. and a suitable belt is a one inch wide Terylene fabric belt.

The securing means 4 is attached to and extends from the inflatable member 1 such attachment can be as shown in FIG. 1, namely by having the securing means in the form of an integral belt 5, joined by the interlocking means 6, threaded through loops 7 and 8 formed on the outer surface of the inflatable member 1. The points 9 and 10 from which the belt 5 extends from the inflatable member 1 are spaced apart and removed from the ends 2 and 3 of the inflatable member 1. It has been found advantageous to have a 30 centimeter spacing between the positions 9 and 10 as with such a spacing the device is usable with any size of person ranging from an infant up to a fully grown adult. The positions 9 and 10 are also removed from the two ends 2 and 3 of the inflatable member 1. It has been found with this arrangement when the device is in position on a person as shown in FIG. 6, and when the person is supported in water the device will hold the head of the person above the surface of the water and furthermore when the body of the person falls in the water face downwards the device will cause the body to rotate to the face upwards position. The life jacket standards of most countries require that a life jacket rotate the body of a person in this manner within five seconds. It has been found that the buoyancy aid of this invention will achieve this rotation within five seconds when the elongated member in the uninflated position is of 55 centimeters in the longest lengthwise dimension parallel to the longitudinal axis and is 19 centimeters in width with the length between the points of attachment 9 and 10 being 30 centimeters.

A substantial reduction in the distance between the points 9 and 10 tends to produce too much leverage on the free end of the inflated device about the body of the person and creates a twisting motion as the person is attempting to swim face downwards through the water, on the other hand if the distance between the two points is substantially increased the elongate inflatable member tends to conform to the shape of the body to become curved in which position it is found difficult to swim as the body tends to roll around in the water and also when immersed face downwards in an unconscious state the apparatus turns the body over much slower.

As shown in FIG. 6 of the drawings the device of the invention when inflated and when attached to the body of the person is substantially straight having two end portions 26 and 27 extending in tangential fashion from the body of the person.

As mentioned previously the securing means when attached around the body of the person lies in a plane substantially parallel to the longitudinal axis of the elongate member 1. Substantial divergence from a parallel state for example by having the securing means diagonally fixed across the device makes it difficult to roll the device up when in an uninflated position as will be discussed later and in addition when inflating, the thickness of the inflated member is pressed against the body of the person with a substantial force giving a crushing effect on the person.

The inflatable member is inflated by an actuating device which acts on and releases from a cylinder containing gas under pressure, preferably $CO_2$, to release the gas to the inflatable member 1 to inflate said member. On release of such gas, for example carbon dioxide, there is a substantial cooling affect produced adjacent the inlet to the inflatable member 1 and it is important to insulate the body of the person from this cooling effect. By providing the loops 7 and 8 on the elongate member 1 through which the belt 5 passes, along the edge of the elongate member, being the edge adjacent where an actuating device 28 for a gas cylinder within the actuating device is located, sufficient insulation is provided to protect the body form said cooling affect.

Figure 4:
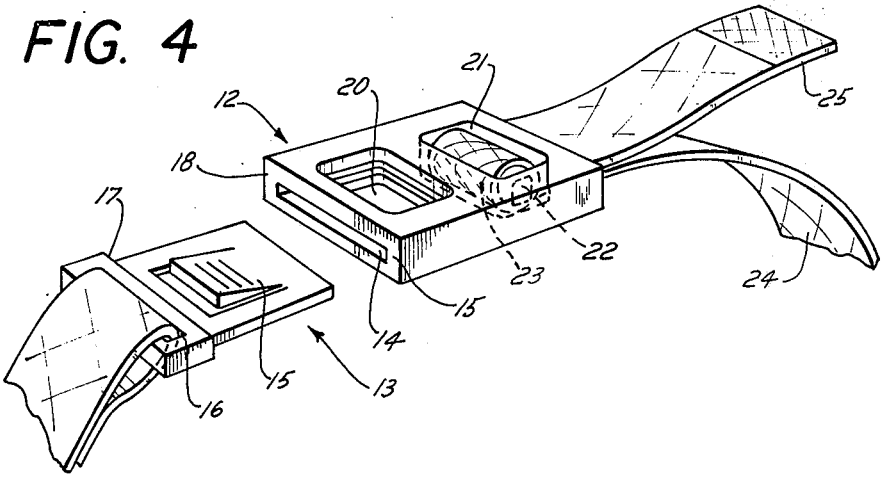
FIG. 4 is a view of the preferred buckle of this invention.

The interlocking means 6 needs to be strong and resistant to corrosion. A suitable buckle is as shown in FIG. 4. The buckle 12 has a male member 13 which engages with a slot in a female member 15. Male member 13 has an eye portion 16 receiving one end of the securing means and also forming a shoulder on its face 17 to butt against the surface 18 of the female member 15. The male member has a tongue portion 19 which is resiliently mounted to slide through slot 14 and engage on springing up in eye 20. A further eye portion 21 in the female member contains a bar 22 slidably mounted in side slots and having serrated edges. The other end of the securing means passes in the manner dotted as 23 over the bar member and is thus secured when the portion 24 is subjected to a pull in the direction away from the male member e.g. when the securing means is secured about a person's waist while adjustment can be effected by pulling either portion 24 or 25 in its freely hanging direction.

Release of the buckle is by finger pressure on the tongue 19 which on depression can freely move backwards through slot 14.

Associated with the inflatable member 1 is an actuating device 28 for providing gas, and actuating means 29 for releasing the gas from the supply into the tubular member so as to inflate it.

The gas supply 28 can be, for example a carbon dioxide gas cylinder containing $CO_2$ gas under pressure which can be frangible or have a puncturable seal. The gas can be released to pulling a cord 29 which is attached to a lever, which in turn forces the cylinder to slide forward on to a stainless steel pin projection which punctures the seal and thus releases the gas. The gas when released can pass from the tubular shaped cylinder into a flexible tube which is part of the inflatable elongate member thus inflating the elongate member.

The securing means enables the buoyant device to be worn as a belt by a user.

When not in use the inflatable portion of the buoyant device is preferably collapsible and rolled or folded with the ends turned in as shown in FIG. 2 into a package which is supported around the waist or body as shown in FIG. 3. The collapsed portion can be secured in the rolled position by press studs or other closure means which are releasable by the pressure of the gas automatically on actuation of the gas cylinder. The gas chamber enclosing the gas release mechanism can underlie the rolled or folded inflatable portion to be protected from wear and tear, for example sunlight.

In the preferred forms of the invention the inflatable device is in the form of a belt which can be conveniently worn around the waist of a swimmer, yachtsman, fisherman and the like and which can be inflated as aforedescribed.

The invention can have alternative features such as a lifting becket fastened onto the belt 5 e.g. at position 30 (FIG. 1) to protrude to the front of the body and a permanent cover which opens on inflation.

In general the size of the inflatable portion need only be such that one obtains a buoyancy of preferably at least 12 lb. and less than 16 lb. although in certain circumstances the buoyancy can be above 16 lbs. where a special purpose requires such. Above 16 lb. buoyancy it becomes difficult to submerge when the device is inflated, for example if the person is trapped underneath a capsized dingy the person would be unable to escape. Less than 12 lbs. buoyancy will give insufficient support for an adult. Most preferably the belt is designed with 14 lbs. buoyancy which will support in water a fully clothed man with waders, or a man in full military dress with equipment.

Figure 5:
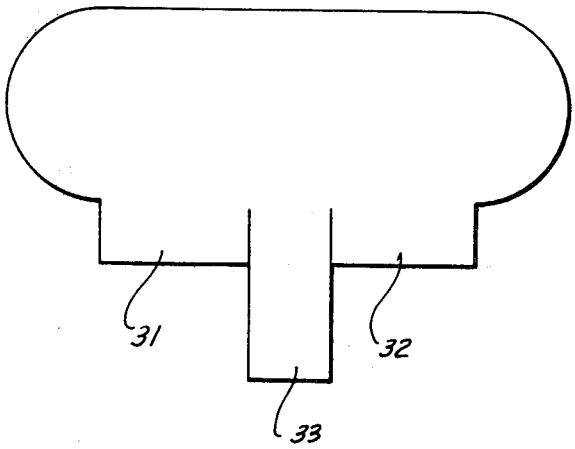
FIG. 5 is a view of the inflatable member during production of the device.

The elongate member can be die cut as shown in FIG. 5 having 3 extensions, two 31 and 32 being turned back and sewn and/or glued to form eyelets to receive the securing means with the third extension 33 being turned back on the reverse side over the means for supplying gas.

The elongate member will generally be of the normal colour for lifejackets and other buoyancy aids and having a black terylene beading sewn around the edges.

Thus by this invention there is provided an inflatable buoyancy device which can be strapped around a person requiring support in the water and which can be operated if and when required so as to provide necessary buoyancy, and is therefor particularly suited for use as a lifesaving device.

Although this invention has been described by way of a preferred form, it is to be understood that modifications can be made thereto without departing from the scope of the invention, as defined in the appended claims.

What I claim is:

1. An inflatable bouyant device comprising an elongate inflatable member having a straight longitudinal axis extending from end to end of the member, securing means attached to and extending from said inflatable member and adapted to encircle the trunk part of the body of a person so that said securing means lies substantially in a plane substantially parallel to the longitudinal axis of the elongate member, an actuating device associated with a gas producing means located in or adjacent the inflatable member such that on operation of the actuating device an amount of gas flows into the inflatable member so as to inflate it and provide buoyancy for a person about which the securing means has been secured characterized in that the securing means extends from two positions spaced apart and removed from each end of the inflatable member to leave two end portions of the inflatable member, when inflated and when secured to the front of the trunk part of the body of the person by the securing means, extending in substantial tangential fashion from the body of the person.

2. An inflatable buoyant device as claimed in claim 1 wherein the inflatable member when inflated is of substantially tubular form having substantially ellipsoidal closed end surfaces.

3. An inflatable buoyant device as claimed in claim 1 wherein the securing means is an integral belt joined together by interlocking means passing through loops in the elongate inflatable member.

4. An inflatable buoyant device as claimed in claim 1, wherein the gas is carbon dioxide.

5. An inflatable buoyant device as claimed in claim 1 wherein the inflatable member is collapsed and rolled or folded into a package supported around the person by the securing means.

6. An inflatable buoyant device as claimed in claim 5 wherein the collapsed inflatable member is secured by closure means which are releasable on actuation of the gas cylinder.

7. An inflatable buoyant device as claimed in claim 6 wherein the closure means are press studs.

8. An inflatable buoyant device as claimed in claim 1 wherein the gas cylinder contains gas sufficient to give at least 12 lb. and less than 16 lb. buoyancy.

9. An inflatable buoyant device as claimed in claim 1, wherein the inflatable member, when inflated, is of tubular form having a substantially uniform cross-section along substantially its entire length.

* * * * *